US007913937B2

(12) United States Patent
Kioi

(10) Patent No.: US 7,913,937 B2
(45) Date of Patent: Mar. 29, 2011

(54) DESCALING SPRAY NOZZLE ASSEMBLY

(75) Inventor: Yoshiyuki Kioi, Sanda (JP)

(73) Assignee: Spraying Systems Co., Wheaton, IL (US)

( * ) Notice: Subject to any disclaimer, the term of this patent is extended or adjusted under 35 U.S.C. 154(b) by 44 days.

(21) Appl. No.: 12/114,389

(22) Filed: May 2, 2008

(65) Prior Publication Data

US 2009/0272826 A1 Nov. 5, 2009

(51) Int. Cl.
*B05B 1/14* (2006.01)
*B05B 1/04* (2006.01)
*B05B 1/00* (2006.01)

(52) U.S. Cl. ..... 239/590.5; 239/592; 239/597; 239/599; 239/472; 239/463

(58) Field of Classification Search ..... 239/590.5, 239/592, 602, 553.5, 536, 590, 461, 462, 239/493, 500, 501, 502, 589–601, 505, 463, 239/472, 506

See application file for complete search history.

(56) References Cited

U.S. PATENT DOCUMENTS 2,629,632 A * 2/1953 Munson ..... 239/590.3
3,104,829 A * 9/1963 Wahlin ..... 239/488
3,510,065 A * 5/1970 Gigantino et al. ..... 239/590
4,068,830 A * 1/1978 Gray ..... 366/175.2
4,207,202 A * 6/1980 Cole, Jr. ..... 261/28
4,848,672 A * 7/1989 Matsumoto et al. ..... 239/590.5
4,875,627 A * 10/1989 Coulston et al. ..... 239/466
5,060,869 A * 10/1991 Bekius ..... 239/599
5,201,341 A * 4/1993 Saito et al. ..... 137/341
5,232,165 A * 8/1993 Tournier ..... 239/462
6,170,760 B1 * 1/2001 Bievenue et al. ..... 239/407
7,028,976 B2 * 4/2006 Bachmann et al. ..... 251/126

FOREIGN PATENT DOCUMENTS

JP 0679339 A * 3/1994

* cited by examiner

*Primary Examiner* — Dinh Q Nguyen
*Assistant Examiner* — Justin Jonaitis
(74) *Attorney, Agent, or Firm* — Leydig, Voit & Mayer, Ltd.

(57) ABSTRACT

A spray nozzle assembly for directing thin, straight line, high pressure liquid spray onto moving steel slabs for penetrating and removing scale buildup in steel processing operations. The spray nozzle assembly includes a high impact attachment tube for accelerating liquid flow, a tungsten carbide spray tip at a discharge end of the high impact attachment tube for directing a flat spray pattern, an inlet defined by a strainer at an upstream end of the high impact attachment tube, and a staged vane section intermediate the inlet and spray tip for reducing liquid turbulence in the flow passageway. The vane section comprises a pair of axially spaced vanes each having a plurality of radial vane elements that define a plurality of laminar flow passageways, with the laminar flow passageways of one vane being circumferentially offset to the laminar flow passageways of the other vane.

22 Claims, 2 Drawing Sheets

DESCALING SPRAY NOZZLE ASSEMBLY

FIELD OF THE INVENTION

The present invention relates generally to spray nozzle assemblies, and more particularly, to descaling spray nozzle assemblies operable for directing a wide thin-line high-pressure liquid discharge for penetrating and removing scale from steel in steel manufacturing operations.

BACKGROUND OF THE INVENTION

Descaling spray nozzle assemblies are extensively used in steel processing for directing a wide thin line high pressure spray onto the surface of steel slabs for penetrating and removing iron oxide scale buildup on the surfaces prior to rolling and subsequent processing of the steel. In such spraying systems, it is desirable that the high pressure liquid discharge be as thin as possible for effecting maximum impact pressure and penetration of the scale. It also is desirable that the distribution of the liquid discharge be uniform across the width of the spray pattern. Heretofore, the liquid distribution often is unevenly reduced toward the opposed ends of the discharging spray pattern, which reduces impact forces and adversely affects the uniformity of the spray penetration and scale removal.

Such descaling spray nozzle assemblies typically comprise a tubular body, sometimes referred to as a high impact attachment tube, formed with a liquid flow passageway that tapers inwardly in a downstream direction for accelerating the liquid flow, a strainer affixed to an upstream end of the tubular body for straining particulate matter and scale from recycled steel mill water typically used in such descaling processing, and a carbon insert spray tip mounted at downstream end of the tubular body having an elongated liquid discharge orifice for forming and directing a flat spray discharge pattern. High pressure liquid directed through the strainer can incur considerable turbulence, which in turn can adversely affect the uniformity and impact force of the discharging spray.

For reducing turbulence and straightening the liquid flow stream through the high impact attachment tube prior to passage through the spray tip, it is known to provide a vane having a plurality of radial vane elements immediately downstream of the strainer, which effectively defines a plurality of circumferentially-spaced laminar flow passages. Since such vane can only have a limited number of radial vane elements, such as on the order of five, it sometimes is incapable of adequately moderating highly turbulent flow streams, such as from turbulence incurred by high pressure liquid entering the strainer in a radial direction and then abruptly changing direction for passage through the strainer and high impact attachment tube. Efforts to provide such a vane with a greater number of radial vane elements have not been acceptable because the additional vanes result in a corresponding reduction in size of the laminar flow passageways, which restricts fluid passage, creates undesirable pressure drops, and in fact increases turbulence.

Such descaling spray nozzle assemblies also are relatively expensive to manufacture, since the components must be precisely formed and assembled in order to achieve acceptable performance. Indeed, without precise radial orientation of the elongated spray tip discharge orifice with respect to the radial vane elements of the liquid straightening vane, the uniformity of the discharging spray pattern again can be adversely affected.

OBJECTS AND SUMMARY OF THE INVENTION

It is an object of the present invention to provide a descaling spraying system having spray nozzle assemblies operable for more efficient and reliable uniform removal of scale from steel slabs.

Another object is to provide a descaling spray nozzle assembly as characterized above which has a liquid straightening vane section for more affectively reducing turbulence in the liquid flow stream through the nozzle for enhanced thin line high-pressure impact on a scaled surface.

A further object is to provide a descaling spray nozzle assembly of the foregoing type in which the vane section further facilitates improved uniformity in the liquid distribution for more uniform impact and scale removal.

Still another object is to provide a descaling spray nozzle assembly of the above kind that has a liquid straightening vane section with greater numbers of radial vane elements than heretofore possible without restricting liquid flow or causing undesirable pressure losses or increased turbulence.

Yet a further object is to provide a descaling spray nozzle assembly which lends itself to more economical manufacturer and assembly. A related object is to provide is to provide such a descaling nozzle assembly in which the spray tip and liquid straightening vane section may be assembled without special orientation of the elongated discharge orifice of the spray tip with respect to the radial vane elements.

Other objects and advantages of the invention will become apparent upon reading the following detailed description and upon reference to the drawings, in which:

Figure 1:
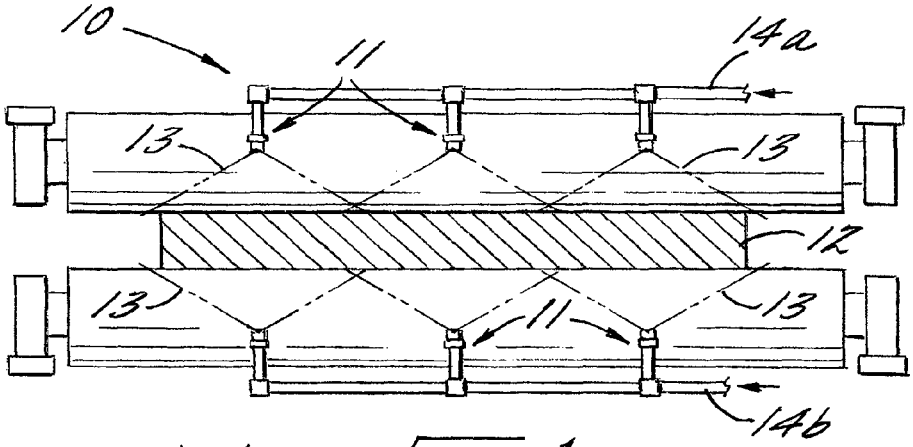
FIG. 1 is a diagrammatic end elevational view of an illustrative descaling spraying system having spray nozzle assemblies in accordance with the invention.
Figure 2:
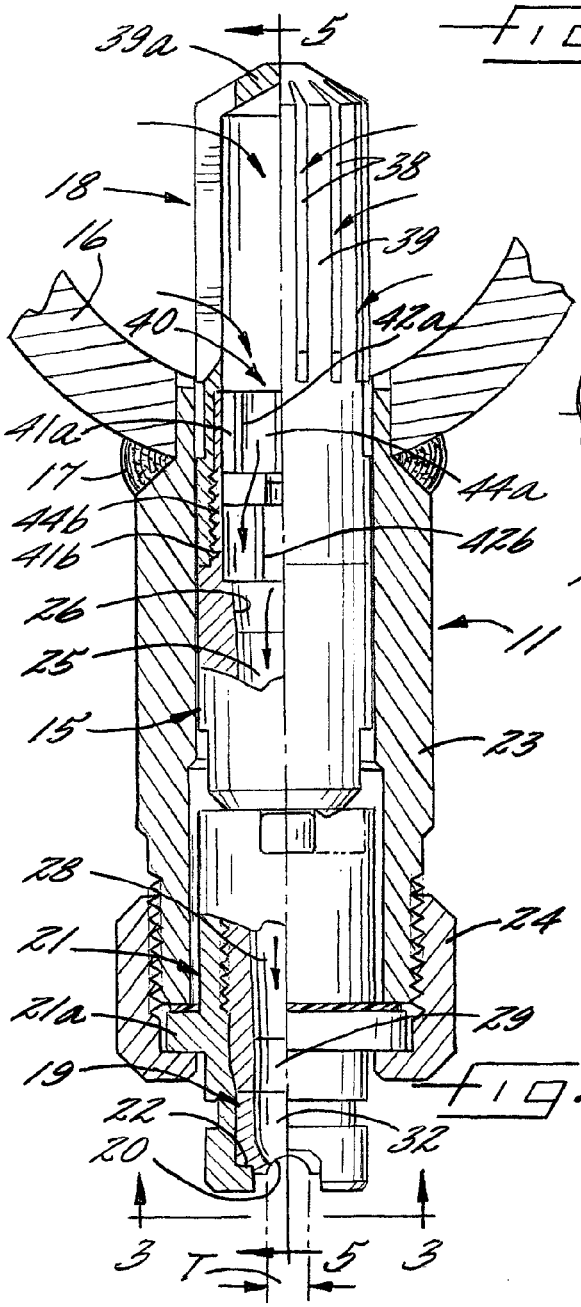
FIG. 2 is an enlarged fragmentary section of one of the descaling spray nozzle assemblies of the illustrative spraying systems.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative descaling spraying system 10 having a plurality of spray nozzle assemblies 11 in accordance with the invention for directing a high pressure liquid spray on opposed sides of a moving steel slab 12 in a steel manufacturing operation. The spraying system 10 in this case comprises upper and lower liquid supply headers 14*a*, 14*b*, typically supplied with mill water that is recycled in the steel manufacturing facility. These spray nozzle assemblies 11 are mounted in laterally-spaced relation along the respective header 14*a*, 14*b* such that a plurality of flat, thin-line spray patterns 13 penetrate and remove scale across the entire width of the steel slab 12. Spray nozzle assemblies 11 in this case are supported in depending fashion from the upper liquid supply header 14*a* for directing liquid spray onto an upper side of the moving slab 12 and the spray nozzle assemblies 11 are supported in upwardly extending relation to the lower liquid supply header 14*b* for directing spray patterns across the underside of the slab 12. Each spray nozzle assembly 11 is supported by its respective header 14*a*, 14*b* with an upstream end within the header for receiving supply liquid from the header and a downstream end disposed outside the header in facing relation to the moving slab 12. Since each of the spray nozzle assemblies 11 are of similar construction, only one need be described herein in detail.

The spray nozzle assemblies 11 each comprise an elongated high impact attachment tube 15 appropriately supported within a wall 16 of the header 14*a*, 14*b*, a strainer 18 mounted at an upstream end of the high impact attachment tube 15 through which supply water from the header enters the spray nozzle assembly, a tungsten carbide insert spray tip 19 mounted at a downstream end of the high impact attachment tube 15 formed with an elongated discharge orifice 20 for discharging and directing a flat spray pattern, and a spray tip retainer 21 for securing the spray tip 19 in mounted position. The strainer 18 in this case has an elongated, generally cup shaped configuration which is threaded onto the upstream end of the high impact attachment tube 15, and the spray tip retainer 21 is threaded onto a downstream end of the high impact attachment tube 15 with an inwardly directed annular lip 22 retaining the spray tip 19 in abutting relation against a downstream end of the high impact attachment tube 15.

The spray nozzle assembly 11 in this case is supported within the header by means of a cylindrical adapter 23 secured within a radial opening in the header by a weldment 17. The adapter 23 in this instance has an externally threaded lower end against which a radial flange 21*a* of the spray tip retainer 21 is retained by an internally threaded retaining ring 24.

For accelerating liquid during passage through the spray nozzle assembly, the high impact attachment tube 15 is formed with a liquid flow passage 25 which tapers inwardly in a downstream direction. In the illustrated embodiment, the liquid flow passage 25 includes a first relatively short tapered section 26 angled about 12° to the longitudinal axis of the high impact attachment tube 15, a relatively longer more gradual tapered section 28 angled at about 5° to the longitudinal axis of the high impact attachment tube, and entry section 29 immediately upstream of the spray tip 19. It will be understood by one skilled in the art that the high impact attachment tube 15 may be integrally formed as shown in the illustrated embodiment, or may comprise multiple longitudinally connected components for ease of manufacture The tungsten carbide insert spray tip 19 in this case is formed with an inlet passage section 32 that communicates between the high impact attachment tube passageway 25 and the discharge orifice 20 through a radiused entry passage section 34. The elongated discharge orifice 20 in this instance is defined by a cylindrical groove or cut 35 extending transversely across the end of the spray tip 19 in intersecting relation with the entry passage section 34.

For straining small particulate matter that might exist in the recycled mill water directed through the headers 14*a*, 14*b* from the flow stream entering the spray nozzle assembly 11, the strainer 18 is formed with a plurality of elongated slits 38 circumferentially about the strainer communicating through a cylindrical sidewall 39 of the strainer and partially into the upstream end 39*a* thereof. The supply water primarily enters the strainer 18 in a radial direction through the elongated slits 38 and must make a 90° change in directional movement, causing turbulence in the liquid, as it is directed toward the inwardly tapered passageway 25 of the high impact attachment tube 15 prior to direction from the spray tip 19. Turbulence in the high pressure liquid flow stream directed to the spray tip 19, as indicated above, can adversely affect the liquid discharge, particularly by increasing the transverse thickness of the thin line spray pattern, which reduces the liquid impact force and penetration, and by altering the liquid distribution, particularly at opposite ends of the wide spray pattern, which can result in uneven liquid penetration and scale removal.

In accordance with an important aspect of the invention, the spray nozzle assembly has a multi-stage liquid straightening vane section which more affectively reduces liquid turbulence prior to direction from the spray tip, with resultant improved control in tightness of the thin, flat spray pattern and uniformity in liquid distribution throughout the spray pattern. More particularly, the vane section comprises a plurality of liquid straightening vanes each having a plurality of radial vane elements, with the radial vane elements of one vane being circumferentially offset with respect to an immediately upstream vane for multi-stage redirection and straightening of the liquid passing through the high impact attachment tube. To this end, in the illustrated embodiment, a vane section 40 is provided that comprises two identical vanes 41*a*, 41*b* each having five radial vane elements 42*a*, 42*b* extending from a center of the respective vane for defining five respective circumferentially-spaced laminar flow passageways 44*a*, 44*b*.

In keeping with the invention, the radial vane elements 42*b* of the downstream vane 41*b* are circumferentially offset from the radial vane elements 42*a* of the upstream vane 41*a* such that the five laminar flow streams exiting the laminar flow passages 44*a* of the upstream vane 41*a* must change direction in a controlled staged manner upon entering the laminar passages 44*b* of the downstream vane 41*b*. In the illustrated embodiment, the radial vane elements 42*b* of the downstream vane 41*b* are offset circumferentially 36° with respect to the vane elements 41*a* of the upstream vane 41*a*, when viewed in an axial direction, so as to be aligned midway through the laminar passageways 44*a* of the upstream vane 41*a*. It will be understood that the vane section 40 could comprise more than two vanes 41*a*, 41*b*, and in that case, the radial vane elements of the successive vanes could be offset circumferentially smaller distances for effecting the staged longitudinal direction of the liquid.

In further carrying out the invention, the vanes 41*a*, 41*b* of the multi-stage vane section 40 are longitudinally spaced apart for defining a transition flow passage 48 between the vanes 41*a*, 41*b* of the two stages. In the illustrated embodiment, the multi-stage vanes 41*a*, 41*b* are axially spaced for defining a transition flow passageway 48 between the outlet ends of the laminar flow passageways 44*a* of the upstream vane 41*b* and the inlet ends of the laminar passageways 44*b* of the downstream vane 41*b*. In this case, the vanes 41*a*, 41*b* each have equal longitudinal lengths L and are separated by an axial gap distance D which defines the length of the transition flow passageway 48 between the vanes 41*a*, 41*b*. In the preferred embodiment, the gap distance D is less than one-half the axial length L of the vanes, and less than 25 percent of the distance K between the inlet end of the upstream vane 41*a* and the outlet end of the downstream vane 41*b*. In an operative embodiment of the invention, the vanes each have an axial length L of 10 mm with a gap distance D of 4 mm. between the vanes.

In further keeping with the invention, the vanes 41*a*, 41*b* have axially extending alignment and spacing members 43*a*, 43*b* for axially spacing and circumferentially aligning the vanes 41*a*, 41*b* with respect to each other as an incident to mounting in the high impact attachment tube 15. In the illustrated embodiment, the upstream vane 41*a* has an axially extending alignment and spacing member or lug 43*a* extending in a downstream direction and the downstream vane 41*b* has an alignment and spacing member or lug 43*b* extending from its upstream end. The alignment and spacing members 43*a*,43*b* each are formed with a cross slot which defines a respective locking and alignment key 48*a*,48*b* and recess 49*a*,49*b* for interlocking engagement between the vanes 41*a*, 41*b*. The locking keys 48*a*,48*b* each have a respective end face 50*a*,50*b* for abutting relation with the recess 49*a*,49*b* of the adjacent vane for establishing the longitudinal spacing therebetween and an alignment face 51*a*,51*b* in an axial plane for establishing a pre-determined circumferential orientation of the vanes 41*a*,41*b* with respect to each other.

Figure 3:
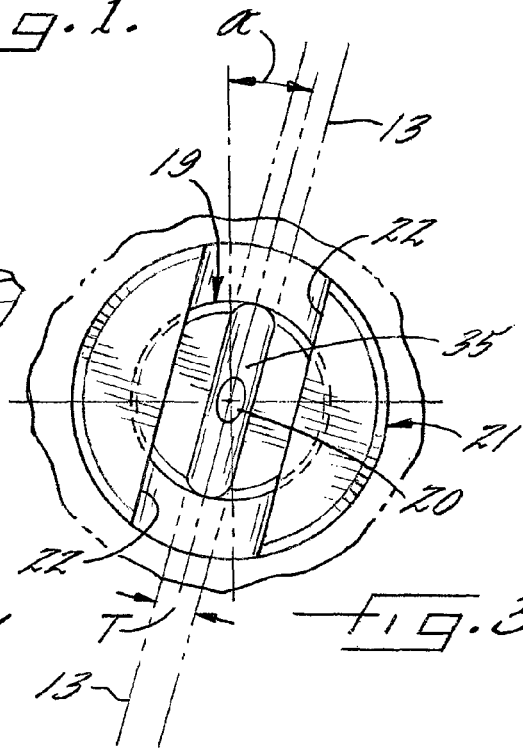
FIG. 3 is an enlarged downstream end view of the illustrated spray nozzle assembly taken in the plane of line 3-3 in FIG. 2.
Figure 4:
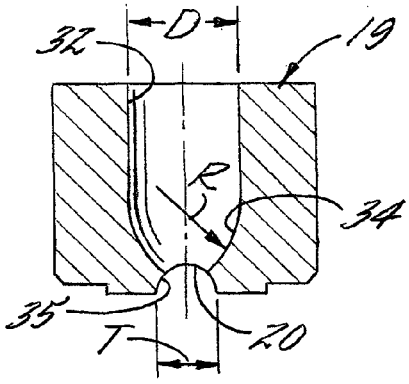
FIG. 4 is an enlarged longitudinal section of the tungsten carbide insert spray tip of the illustrated spray nozzle assembly.
Figure 5:
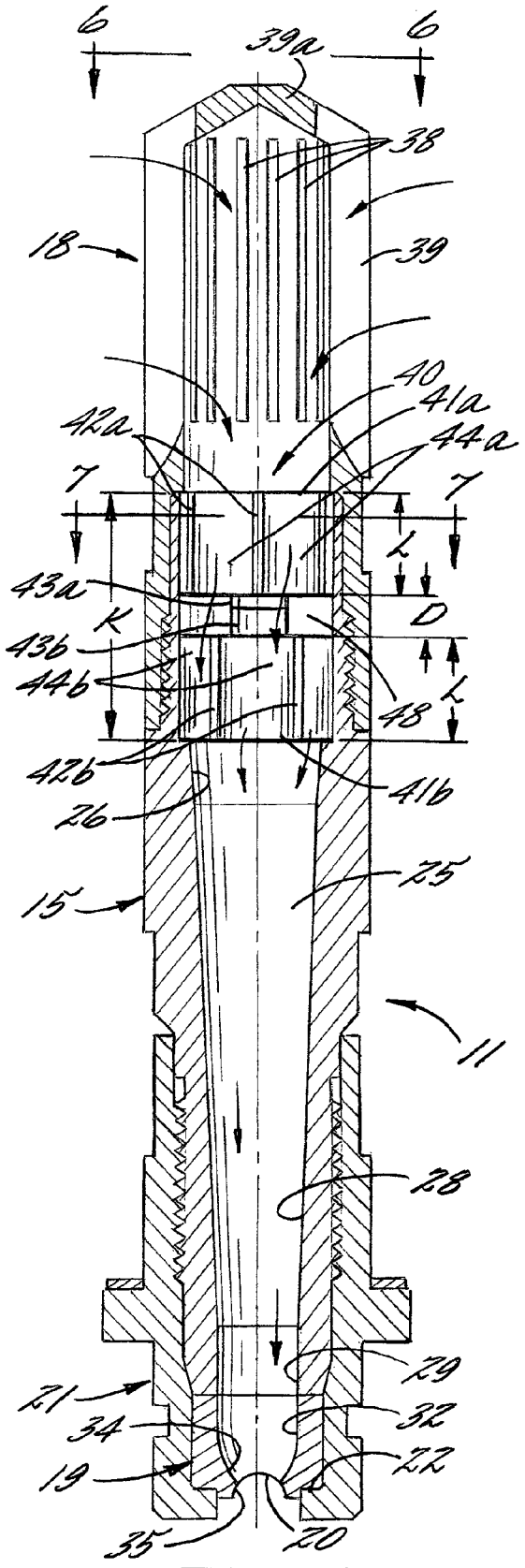
FIG. 5 is an enlarged longitudinal section of the illustrated spray nozzle assembly, taken in the plane of line 5-5 in FIG. 2.
Figure 6:
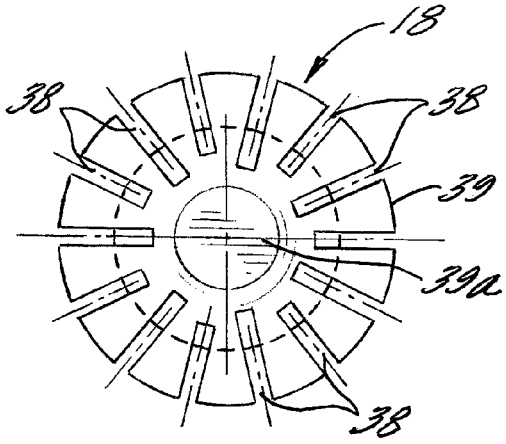
FIG. 6 is an upstream end view of the liquid inlet strainer of the illustrated spray nozzle assembly, taken in the plane of line 6-6 of FIG. 5.
Figure 7:
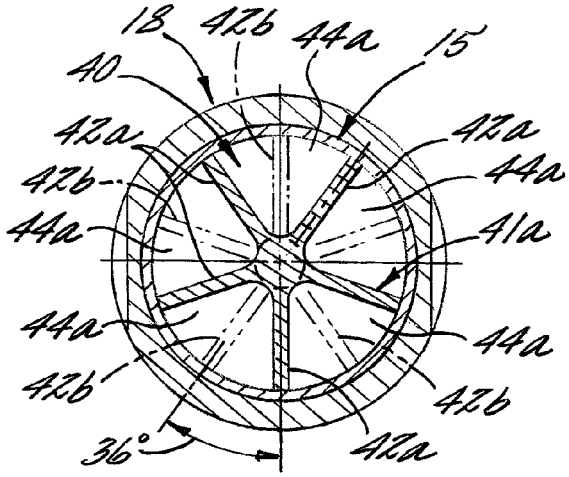
FIG. 7 is an transverse section of the spray nozzle assembly through a liquid straightening vane thereof, taken in the plane of line 7-7 in FIG. 5.
Figure 8:
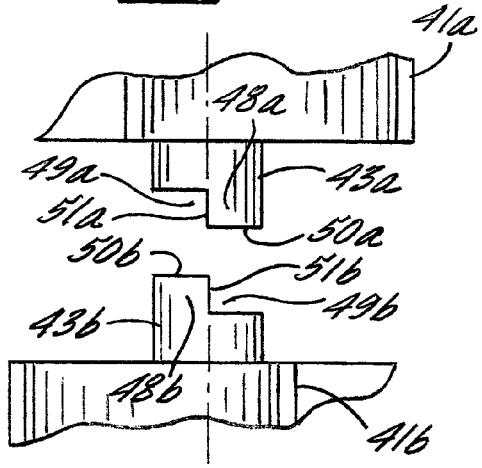
FIG. 8 is an enlarged and exploded fragmentary view depicting the axial alignment and spacing members of the pair of vanes of the illustrated spray nozzle assembly.

The multi-stage vane section 40 has unexpectedly been found to improve spray performance characteristics of the discharging flat spray pattern. The discharging spray has a more controlled narrow transverse thickness T (FIG. 3) for higher pressure impact and penetration into the scale surfaces of steel slabs. The liquid distribution also is substantially uniform across the entire width of the thin line spray for enhanced uniform removal of scale from the slab. While the theory of operation is not completely understood, it is believed that the improved straightening and turbulence suppression of the multi-stage vane section 40 is effected by the liquid being controlled by the greater number of radial vane elements 42*a*, 42*b* of the plurality of vanes 41*a*, 41*b*. In the illustrated embodiment, for example, the liquid is controlled and redirected by 10 radial vane elements 42*a*, 42*b*. By virtue of the staging of the vanes 41*a*, 41 *b*, however, the greater multiplicity of radial vane elements neither unduly restrict the laminar flow passageways 44*a*, 44*b*, nor imparts turbulence or substantial pressure losses in the flow stream, which would otherwise occur utilizing a single vane having ten radial vane elements which by necessity would result in closer circumferential spacing of the radial vane elements.

It has further been found that the spray nozzle assembly of the present invention enables more economical manufacture with reduced tolerance requirements. In prior descaling nozzles it has been found that tolerance variations in formation of the spray tip discharge orifice, the other components of the spray nozzle assembly, or in orientation the positioning of the elongated spray tip orifice 20 with respect to the laminar flow passageways, could influence the spray performance. The spray nozzle assembly of the present invention enables greater tolerance variations and random orientation of the elongated spray tip discharge orifice with respect to the laminar flow passageways without altering the liquid distribution or thin line impact of the discharging spray.

The invention claimed is:

1. A high impact liquid spray nozzle assembly comprising an elongated tubular member having liquid passageway that extends with an inwardly tapered diameter in a downstream direction along a longitudinal axis of the liquid passageway, a spray tip at a downstream end of said tubular support member having an elongated discharge orifice oriented transverse to the longitudinal axis of the liquid passageway for emitting and directing a flat liquid spray pattern, an inlet communicating with an upstream end of said tubular member liquid passageway upstream of said spray tip, a multi-stage vane section intermediate said inlet and spray tip, said multi-stage vane section comprising a plurality of vanes including an upstream vane and a downstream vane, said vanes each having a plurality of flat radial vane elements extending in radial planes through the longitudinal axis of said liquid passageway defining a plurality of longitudinally extending circumferentially spaced laminar flow passageways communicating between said inlet and said tubular member liquid passageway for directing liquid longitudinally in a direction parallel to the longitudinal axis of the liquid passageway, and said radial vane elements of said downstream vane being in circumferentially offset relation to the radial vane elements of said upstream vane.

2. The spray nozzle assembly of claim 1 in which said vanes each are similarly shaped with identical numbers of vane elements.

3. The spray nozzle assembly of claim 1 in which said vanes each have a similar number of radial vane elements.

4. The spray nozzle assembly of claim 1 in which said vanes are mounted in circumferentially offset relation to each other such that the radial vane elements of said downstream vane are oriented in substantially centered relation to pairs of radial vane elements of the upstream vane when viewed in an axial direction thereof.

5. The spray nozzle of claim 1 in which said vanes are mounted in axially spaced relation to each other so as to define a transition passageway of predetermined axial length between the vanes.

6. The spray nozzle of claim 5 in which said transition passageway has an axial length no greater than half an axial length of either of said individual vanes.

7. The spray nozzle of claim 1 in which said vanes each have between four and six radial vane elements.

8. The spray nozzle of claim 5 in which said transitional passageway has an axial length no greater than one-fourth the axial distance between an upstream end of said upstream vane and a downstream end of said downstream vane.

9. The spray nozzle of claim 1 in which said inlet is defined by a strainer formed with a plurality of longitudinal openings disposed circumferentially about the strainer in parallel relation to a longitudinal axis of said elongated tubular member passageway.

10. The spray nozzle of claim 5 in which at least one of said vanes has an axially extending member for automatically establishing the axial spacing of between adjacent vanes.

11. A high impact liquid spray nozzle assembly comprising an elongated tubular member having a liquid passageway that extends with an inwardly tapered diameter in a downstream direction along a longitudinal axis of the liquid passageway, a spray tip at a downstream end of said tubular support member having an elongated discharge orifice oriented transverse to the longitudinal axis of the liquid passageway for emitting and directing a flat liquid spray pattern, an inlet communicating with an upstream end of said tubular member liquid passageway upstream of said spray tip, a multi-stage vane section intermediate said inlet and spray tip, said multi-stage vane section comprising a plurality of vanes including an upstream vane and a downstream vane, said vanes each having a plurality of flat radial vane elements in radial planes through the longitudinal axis of said liquid passageway defining a plurality of longitudinally extending circumferentially spaced laminar flow passageways communicating between said inlet and said tubular member liquid passageway for directing liquid longitudinally in a direction parallel to the longitudinal axis of the liquid passageway, said radial vane elements of said downstream vane being in circumferentially offset relation to the radial vane elements of said upstream vane, said vanes being mounted in axially spaced relation to each other so as to define a transition passageway of predetermined axial length between the vanes, and said vanes each having an axially extending alignment and spacing member for automatically establishing the longitudinal spacing and circumferential orientation of the vanes with respect to each other.

12. The spray nozzle of claim 11 in which said alignment and spacing members each have an alignment surface in an axial plane for establishing the circumferential orientation of the circumferential orientation of the vanes with respect to each other.

13. The spray nozzle of claim 11 in which said spacing and alignment members each are formed with a respective locating key and recess with the key of one said member being received within the recess of the other said member.

14. A descaling spraying system for removing an outer layer of scale from steel slabs during steel processing comprising a tubular header for supplying liquid to be sprayed during descaling, a plurality of spray nozzle assemblies mounted on a header in longitudinally-spaced relation to each other along the header for receiving liquid from said header for direction to the moving slab, said spray nozzle assemblies each including a high impact attachment tube having a liquid passageway that extends with an inwardly tapered diameter in a downstream direction along a longitudinal axis of the liquid passageway of the tube, a spray tip at a downstream end of said high impact attachment tube having an elongated discharge orifice oriented transverse to the longitudinal axis of the liquid passageway for emitting and directing a flat spray pattern, an inlet communicating between an upstream end of said high impact attachment tube passageway and said header multi-stage vane section comprising first and second vanes communicating between said inlet and said high impact attachment tube passageway, said first vane being disposed at a location upstream of said second vane, said vanes each having a plurality of radial flat elements extending in radial planes through the longitudinal axis of said liquid passageway that define a plurality of circumferentially spaced laminar flow passageways communicating between said inlet and said high impact attachment tube passageway for directing liquid longitudinally in a direction parallel to the longitudinal axis of the liquid passageway, and said laminar flow passageways defined by the radial vane elements of said first vane being in circumferentially offset relation to the laminar flow passageways defined by the radial vane elements of said second vane.

15. The descaling spraying system of claim 14 in which said inlet of each spray nozzle assembly is defined by a strainer, said strainer being formed with a plurality of longitudinally extending inlet passages at circumferentially-spaced locations about the strainer parallel to the longitudinal axis of said high impact attachment tube for receiving liquid from said header at a right angle to the longitudinally axis of said high impact attachment tube.

16. The descaling spraying system of claim 15 in which the vanes of each said spray nozzle assembly are identical in form.

17. The descaling spraying system of claim 14 in which said vanes of each spray nozzle assembly each have a similar number of radial vane elements.

18. The descaling spraying system of claim 14 in which the vanes of each spray nozzle assembly are mounted in circumferentially offset relation to each other such that the radial vane elements of the first vane are oriented in substantially centered relation to the radial vane elements of the second vane when viewed in an axial direction thereof.

19. The descaling spraying system of claim 14 in which the vanes of each spray nozzle assembly are mounted in axially spaced relation to each other so as to define a transition passageway of predetermined length between the vanes of the spray nozzle assembly.

20. The descaling spraying system of claim 14 in which at least one of the vanes has a longitudinally extending spacing and alignment lug engageable with the other vane for establishing axial spacing between the vanes and relative circumferential orientation.

21. The descaling spraying systems of claim 1 in which said vane elements each have an axial length measured parallel to the longitudinal axis of said passageway, a radial width measured in a radial direction with respect to the longitudinal axis of the liquid passageway, and a transverse thickness measured transverse to the axial length and radial width, and said vanes have an axial length greater than their transverse thickness.

22. The descaling spraying systems of claim 21 in which said vane elements each have an axial length greater than their radial width.

* * * * *